United States Patent [19]

Manning

[11] 4,357,805

[45] Nov. 9, 1982

[54] METHOD FOR INTEGRATING COMPONENTS OF A REFRIGERATION SYSTEM

[75] Inventor: John D. Manning, Liverpool, N.Y.

[73] Assignee: Carrier Corporation, Syracuse, N.Y.

[21] Appl. No.: 299,351

[22] Filed: Sep. 4, 1981

Related U.S. Application Data

[62] Division of Ser. No. 142,517, Apr. 21, 1980, Pat. No. 4,316,366.

[51] Int. Cl.[3] ..... F25B 5/00

[52] U.S. Cl. ..... 62/117

[58] Field of Search ..... 62/113, 117, 199, 200, 62/505, 513

[56] References Cited

U.S. PATENT DOCUMENTS

| | | | |
|---|---|---|---|
| 2,274,391 | 2/1942 | Zwickl | 62/117 |
| 2,277,647 | 3/1942 | Jones | 62/115 |
| 2,386,198 | 10/1945 | Dodson | 62/200 |
| 2,388,556 | 11/1945 | Lathrop | 62/20 0 |
| 3,165,905 | 11/1965 | Ware | 62/219 |
| 3,232,074 | 2/1966 | Weller | 62/505 |
| 3,381,487 | 5/1968 | Harnish | 62/117 |
| 4,014,182 | 3/1977 | Granryd | 62/117 |
| 4,141,708 | 2/1979 | Lavigne, Jr. et al. | 62/117 |
| 4,142,381 | 3/1979 | Lavigne, Jr. et al. | 62/510 |
| 4,144,717 | 3/1979 | Anderson et al. | 62/117 |

*Primary Examiner*—Ronald C. Capossela

*Attorney, Agent, or Firm*—J. Raymond Curtin; Robert P. Hayter

[57] ABSTRACT

A flash subcooler is provided to meter a portion of the refrigerant flowing from the condenser to the evaporator to an intermediate heat exchanger to subcool refrigerant flowing from the condenser to the evaporator. This diverted refrigerant is flashed to provide subcooling and is then redirected to the compressor as is the flow of refrigerant from the evaporator. Both the refrigeration system and subassemblies for accomplishing the above are disclosed as well as methods of operation thereof.

9 Claims, 4 Drawing Figures

METHOD FOR INTEGRATING COMPONENTS OF A REFRIGERATION SYSTEM

This application is a division of Ser. No. 142,517, filed Apr. 21, 1980 now U.S. Pat. No. 4,316,366, issued Feb. 23, 1982.

BACKGROUND OF THE INVENTION

1. Field of the Invention

This invention in general relates to refrigeration circuits and a method of operation thereof. More particularly, this invention relates to refrigeration circuits, components, and subassemblies and methods of operating same wherein a condenser designed to operate as a portion of a high efficiency refrigeration circuit is paired with an evaporator designed to operate as a portion of a lower efficiency refrigeration circuit.

2. Prior Art

In a typical residential air conditioning application, a condenser is mounted in heat exchange relation with ambient air and an evaporator is mounted in heat exchange relation with the air of the enclosure to be conditioned. A compressor and an expansion device are joined with the condenser and evaporator to form a refrigeration circuit such that heat energy may be transferred between the enclosure air and ambient air.

As the cost of energy to operate an air conditioning system has increased, the manufacturers of air conditioning equipment have attempted to produce more energy efficient equipment. This change in energy efficient equipment has resulted in certain operational characteristic changes between earlier produced equipment and newer higher efficiency equipment.

One of the ways of achieving higher efficiency in an air conditioning system is to decrease the head pressure and consequently the condensing pressure.

In a typical residential air conditioning installation, the components of the refrigeration system perform for their useful life and then need to be replaced. Other components, often the indoor heat exchanger, may have a longer useful life and may continue to perform satisfactorily although the other components need to be replaced. This partial replacement may result in the compressor and condenser being replaced and the evaporator remaining from the original system.

The energy conscious consumer often desires to replace a portion of a system with newer higher efficiency equipment. The utilization of this higher efficiency equipment, however, presents a problem when it is combined with the evaporator from a refrigeration system having capillary tubes as expansion devices. The mating of refrigeration circuit components being designed to operate at different head pressures may result in a decreased capacity of the system, lowering the overall efficiency of the system and/or other operational problems. The severity of these problems depend upon various factors including the expansion device associated with the indoor heat exchanger and the sizing of interconnecting piping. Oftentimes an expansion device of a residential size evaporator comprises a series of fixed diameter capillary tubes.

Capillary tubes which are often used as the expansion devices in a residential size evaporator act to reduce the pressure of refrigerant flowing therethrough. These capillary tubes are sized to allow a predetermined mass flow rate at a given temperature and head pressure. If the head pressure is reduced the mass flow rate through the capillary tube may also be reduced. However, should the temperature of the refrigerant flowing through the capillary tube be reduced, the mass flow rate may increase since the viscosity of liquid refrigerant decreases as it is further subcooled.

The present refrigeration system and components are designed to provide an efficient refrigeration circuit having a replacement component designed to operate at a lower head pressure than the existing component to which it is to be matched.

Prior art devices incorporating subcoolers and intermediary heat exchangers are known in the art. The present invention utilizes an intermediate heat exchanger as a flash subcooler such that a portion of the liquid refrigerant circulating from the condenser to the evaporator is diverted to the intermediate heat exchanger wherein it is flashed to the compressor suction pressure. As the refrigerant changes state from a liquid to a gas it absorbs heat energy from the refrigerant flowing from the condenser to the evaporator subcooling same. Hence, the flow rate of refrigerant flowing through the condenser is different from the flow rate through the evaporator. However, the diverted portion of the refrigerant is not wasted since the heat energy that may have been absorbed upon the flashing of that refrigerant in the evaporator is used to further subcool the refrigerant entering the evaporator.

SUMMARY OF THE INVENTION

It is an object of the present invention to provide a refrigeration circuit having a flash subcooler for cooling refrigerant flowing from the condenser to the evaporator.

It is a further object of the present invention to provide an assembly for incorporating a high efficiency, low head pressure condenser with a lower efficiency, high head pressure evaporator.

It is a yet further object of the present invention to provide a method of operating a refrigeration system.

It is another object of the present invention to provide a combination of components which may be incorporated with an existing component in a refrigeration system such that the system is integrated achieving the highest efficiency for all the components.

It is another object of the present invention to provide a safe, economical, reliable and easy to manufacture subassembly for achieving the above objects.

Other objects will be apparent from the description to follow and from the appended claims.

These and other objects are achieved in accordance with the preferred embodiment of the present invention wherein there is provided an intermediate heat exchanger located to have at least a portion of the refrigerant flowing from the condenser to the evaporator passing through a first flow path of the intermediate heat exchanger. Means are provided to divert a portion of the refrigerant flowing from the condenser to the evaporator to a second flow path of the intermediate heat exchanger wherein the diverted portion of the refrigerant is placed in heat exchange relation with the refrigerant flowing through the first flow path of the heat exchanger. Furthermore, tubing is provided to connect the second flow path of the heat exchanger to the compressor suction line such that a flow path for the diverted refrigerant to be returned to the compressor is provided therethrough. A thermal expansion valve is connected to regulate the flow rate of refrigerant diverted to the second flow path of the intermediate heat exchanger. A temperature sensing bulb of the thermal expansion device is mounted to sense the temperature of the refrigerant flowing from the evaporator to the compressor and to regulate the flow that is diverted as a function thereof. An equalizing line is provided between the compressor suction line and the thermal expansion valve to balance the thermal expansion valve.

DESCRIPTION OF THE PREFERRED EMBODIMENT

The embodiments hereinafter described will refer to a refrigeration circuit for use in an air conditioning system. It is to be understood that the invention herein has like applicability to refrigeration and applications other than air conditioning. The preferred embodiment herein is further described as applying to a residential application wherein the various components have certain flow rate characteristics. This invention is not limited to this application nor to the characteristics of the components replaced or the components mated therewith.

The invention herein is described having a particular heat exchanger for accomplishing heat transfer between the various refrigerant flows. The choice of a heat exchanger is that of the designer as may be the choice of expansion apparatus and other interconnecting means.

In a conventional vapor compression refrigeration circuit gaseous refrigerant has its temperature and pressure increased by the compressor and is then discharged to the condenser wherein heat energy is discharged and the gaseous refrigerant is condensed to a liquid refrigerant. The liquid refrigerant then undergoes a pressure drop in the expansion device such that liquid refrigerant may vaporize to a gas in the evaporator absorbing heat energy from fluid to be cooled. The gaseous refrigerant is then returned to the compressor to complete the refrigeration circuit.

Figure 1:
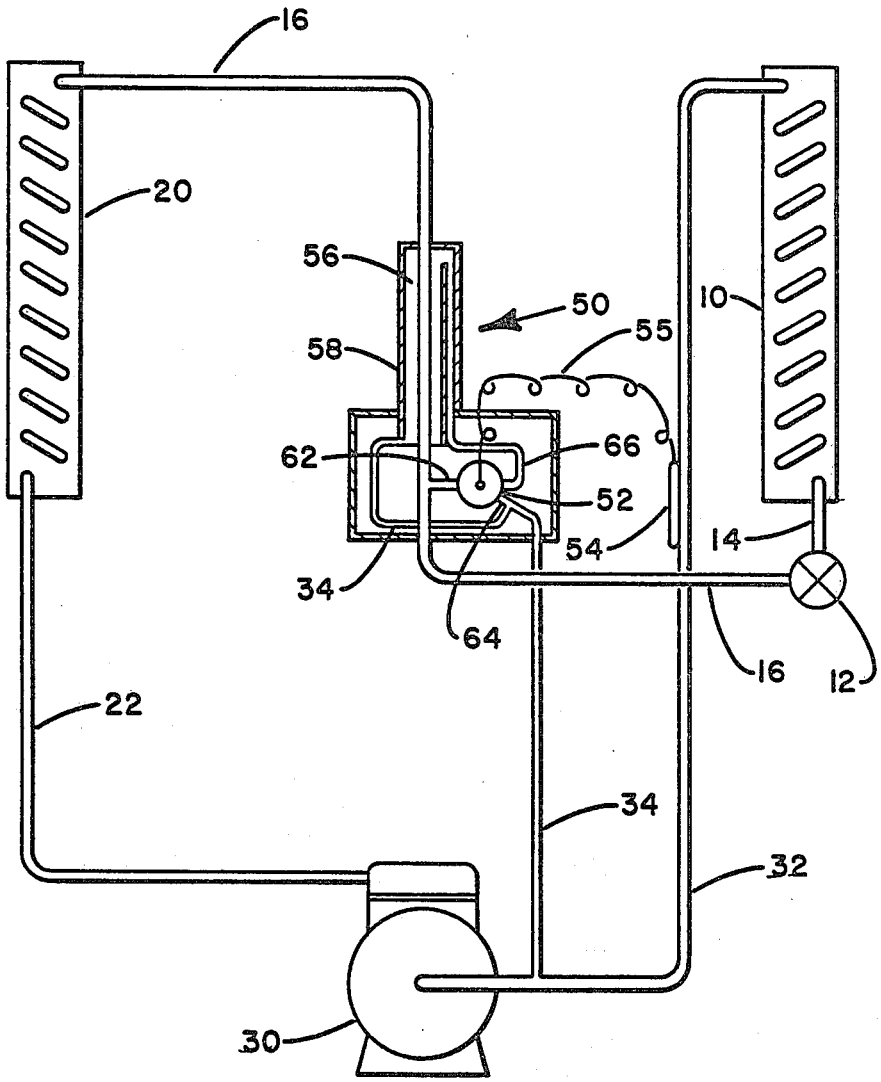
FIG. 1 is a schematic diagram of a refrigeration circuit incorporating the present invention.

Referring first to FIG. 1 there may be seen a schematic view of a refrigeration circuit incorporating the present invention. Compressor 30 is shown having compressor discharge line 22 connected to condenser 20. Interconnecting line 16 connects condenser 20 to expansion device 12. Line 14 connects expansion device 12 to evaporator 10 which is connected by compressor suction line 32 to compressor 30.

Flash subcooler 50 is shown in FIG. 1 having interconnecting line 16 running therethrough. Flash subcooler 50 includes thermal expansion valve 52 connected by thermal expansion valve feed line 62 to interconnecting line 16. Thermal expansion valve discharge line 66 connects the thermal expansion valve to flash chamber 56 of the flash subcooler. Subcooler suction line 34 connects the flash chamber to the compressor suction line 32. Thermal expansion valve equalizer line 64 additionally connects thermal expansion valve 52 to the compressor suction line 32 via subcooler suction line 34.

Bulb 54 of the thermal expansion valve is connected by capillary 55 to the thermal expansion valve. The bulb is mounted on the compressor suction line to sense the temperature of the refrigerant flowing from the evaporator to the compressor.

Figure 2:
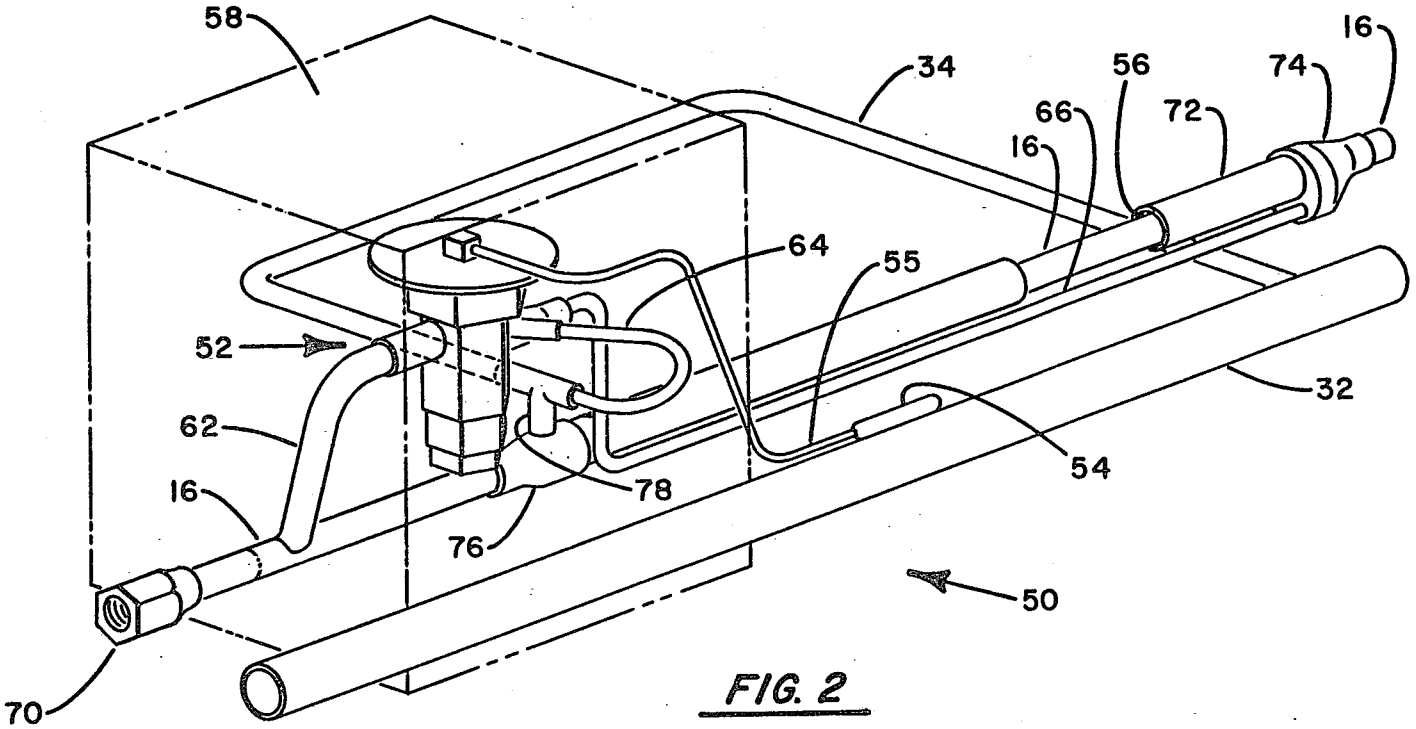
FIG. 2 is an isometric view of a subassembly including the heat exchanger and thermal expansion valve.

Referring now to FIG. 2, there may be seen an isometric view of the flash subcooler 50. A casing 58 is provided which may be insulated (not shown) and has the thermal expansion valve and various connections therein. Interconnecting line 16 is shown forming a first flow path of the heat exchanger. The outside surface of interconnecting line 16 and outer tube 72 form a second flow path of the heat exchanger. The space therebetween is designated as flash chamber 56. Refrigerant flow from interconnecting line 16 may be diverted to the thermal expansion valve through thermal expansion valve feed line 62. The refrigerant flowing through line 62 passes to the valve and is discharged from the thermal expansion valve to line 66. Thermal expansion valve line 66 may be a simple tube or it may be a capillary tube to further limit the flow of refrigerant therethrough and to smooth out the fluctuations of the thermal expansion valve. As used herein the expansion device will refer to either the thermal expansion valve solely or the combination of capillary tubes connected to the discharge of the thermal expansion valve.

It is further seen in FIG. 2 that bulb 54 of the thermal expansion valve is connected by capillary 55 thereto. The bulb is mounted on the compressor suction line 32 to sense the temperature of the refrigerant flowing therethrough. Refrigerant from the thermal expansion valve is supplied through the tube 66 to connector 74. From connector 74 the refrigerant flows through flash chamber 56 to connector 76. The refrigerant then flows through connector 76, through tee 78 and through subcooler suction line 34 to the compressor suction line. Thermal expansion valve equalizing line 64 is also shown connected to tee 78 and to the thermal expansion valve.

Figures 3, 4:
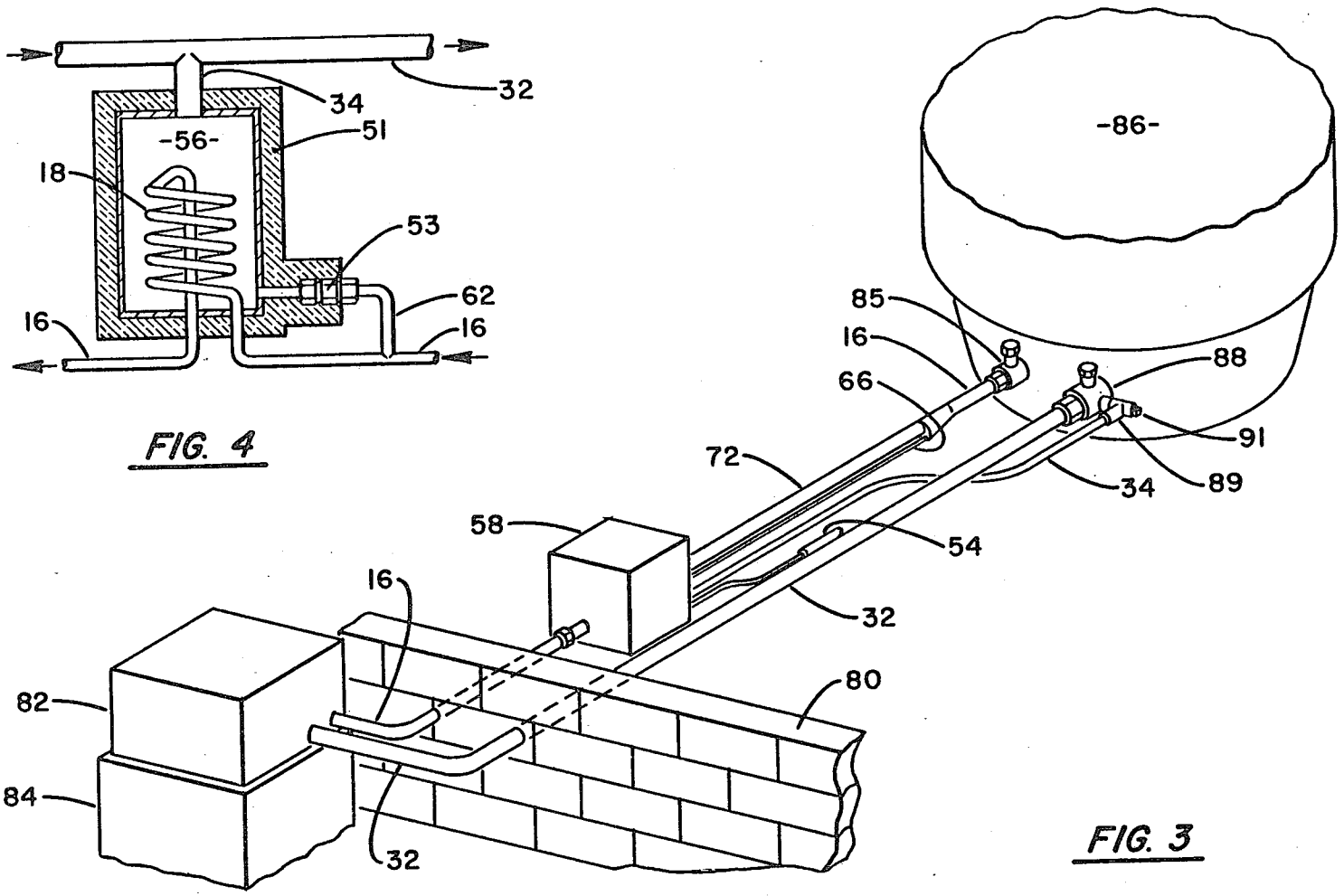
FIG. 3 is a schematic plan view of a residential air conditioning system including an indoor unit and an outdoor unit.
FIG. 4 is a schematic view of a portion of a refrigeration circuit showing another embodiment of the present invention.

In FIG. 3 there can be seen a typical application of this subcooler to a residential air conditioning system. Outdoor heat exchanger 86 is shown having service valves 85 and 88 to make connections to the indoor heat exchange unit 82. The indoor unit, shown within enclosure wall 80, is located in the basement or otherwise within the enclosure to be conditioned and has a blower assembly 84 for circulating air and a heat exchanger located within the indoor heat exchange unit 82. Interconnecting tubing designated as interconnecting line 16 and compressor suction line 32 are also shown.

It can be seen in FIG. 3 that subcooler 50 is connected by replacing a portion of interconnecting line 16 with the flash subcooler assembly. It can be seen that connectors are provided at both ends of the assembly such that they may be connected to service valve 85 and to interconnecting line 16. The temperature sensing bulb of the thermal expansion valve is shown as it is fastened to compressor suction line 32. Additionally, the subcooler suction line 34 is shown connected to service valve 88 through a shrader tee 89. A cap 91 is also located in the shrader tee such that a closed refrigeration circuit is provided and that refrigerant may be bled into or taken from the system through the port. Hence, as can be seen in FIG. 3 the utilization of this subcooler assembly requires a subcooler line being attached to the shrader tee, a thermal expansion valve bulb being connected to the suction line and the heat exchange portion of the subassembly being substituted for a portion of interconnecting line 16.

FIG. 4 shows a separate embodiment of a subcooler assembly. Therein there can be seen interconnecting line 16 which is formed to include heat exchanger 18 within flash chamber 56 of the unit. Refrigerant flowing from the condenser flows through interconnecting line 16 through the coil 18 and is then discharged through line 16 to the evaporator. Line 62 connects line 16 to a fixed orifice expansion device 53. Fixed orifice expansion device 53 is connected to the flash chamber such that liquid refrigerant from line 16 may enter same and be flashed. Subcooler suction line 34 connects the flash chamber to the compressor suction line such that a closed circuit is formed for the flow of refrigerant through line 62, to the expansion device, flash chamber and finally to the compressor.

Other configurations of the flash subcooler might include coiling the tube in tube heat exchanger into a helical configuration such that the entire heat exchanger is located within casing 58. Also, the thermal expansion valve may be located between the condenser and the heat exchanger rather than between the heat exchanger and the evaporator.

OPERATION

During operation of the various components herein hot condensed liquid refrigerant from the condenser flows through interconnecting line 16 to the evaporator. A portion of this liquid is diverted through the thermal expansion valve feed line 62 to the thermal expansion valve. This refrigerant flow through the feed line is regulated by the expansion valve and directed to flash chamber 56 wherein it vaporizes absorbing heat energy from the refrigerant flowing through interconnecting line 16. This flashing of a portion of refrigerant acts to subcool the remaining liquid refrigerant which is then conducted to expansion device 12 and to the evaporator where it absorbs heat energy from the fluid to be cooled. By subcooling the liquid refrigerant the capacity of a given flow rate to absorb heat energy in the evaporator is increased. The flashed refrigerant in the flash chamber is drawn through the subcooler suction line 34 to the compressor suction line 32. Hence, both the flashed gaseous refrigerant from the evaporator and from the flash chamber are drawn at the same suction pressure to the compressor.

Thermal expansion valve 52 is a conventional valve having a diaphragm whose position is regulated as a function of some other temperature. In this instance, it is the temperature of the compressor suction line which acts to regulate the flow to the flash chamber. When the temperature of the compressor suction line increases it indicates that the flow rate of refrigerant to the evaporator is insufficient and that the refrigerant flowing from the evaporator is superheated to a point where system efficiency is decreased. Hence, the thermal expansion valve will increase the flow of refrigerant to the flash subcooler such that the refrigerant flowing to the evaporator is further subcooled and the mass flow rate of refrigerant through the capillary tubes will increase.

If the temperature sensing bulb ascertains that the temperature of the refrigerant flowing from the evaporator is too low it is an indication that too much refrigerant is being supplied to the evaporator. The low temperature may reflect a high flow rate such that there is an insufficient opportunity to transfer heat energy from the refrigerant in the evaporator to the air flowing thereover. Under these circumstances, the thermal expansion valve will act to decrease the flow of refrigerant diverted from interconnecting line 16 such that flow is decreased to the evaporator. The decrease of flow through the thermal expansion valve will decrease the subcooling of the refrigerant flowing through interconnecting line 16. The low temperature discharge situation is to be carefully avoided to prevent liquid refrigerant from being cycled to the compressor.

APPLICATION

When a condensing unit of a refrigeration circuit including a compressor having a first head pressure is replaced by a condensing unit designed to operate at a lower head pressure it is necessary to integrate the components of the refrigerant circuit since they may have different design pressures. The high efficiency equipment available today utilizes a lower head pressure than earlier manufactured air conditioning systems including indoor heat exchangers consequently to replace only the compressor and condenser requires additional apparatus to achieve the highest efficiency available for the system. This integration of equipment, as disclosed herein, includes the use of the flash subcooler arrangement for subcooling refrigerant flowing to the evaporator. The subcooling of the refrigerant flowing to the evaporator acts to allow the capillary tubes of the evaporator to maintain a mass flow rate of refrigerant notwithstanding a lower head pressure. This is accomplished by subcooling a portion of the liquid refrigerant entering the evaporator such that the capacity of the unit may be maintained at the lower head pressure.

Many of the existing evaporators designed to have a lesser flow rate utilize capillary tubes as an expansion device. The amount of refrigerant which may flow through a capillary tube is a function of pressure and temperature of the refrigerant. Since the temperature of the liquid refrigerant leaving the condenser is limited by air temperature in an air cooled application, raising the pressure has been a conventional method of improving feeding to an evaporator. Increasing the pressure can be achieved by adding more charge of refrigerant to the system. However, after a certain point of increasing charge degradation of performance will occur due to excessive liquid being stored in the condenser which minimizes effective coil surface.

Consequently, by flash subcooling the refrigerant supplied to the evaporator, the temperature rather than the pressure of the refrigerant is affected and a high efficiency system may be maintained without increasing the head pressure. Additionally, in any fixed orifice metering device there is a problem of starving and flooding at conditions other than design point. The addition of the thermal expansion valve of the flash subcooler in combination with the metering device acts to provide some flexibility in the system to provide for optimum performance.

The invention herein has been described with reference to particular embodiments. It is to be understood by those skilled in the art that various changes and modifications may be made and equivalents substituted for the elements and method steps thereof without departing from the scope of the invention.

I claim:

1. A method of operating a refrigeration circuit having a compressor, condenser and evaporator which comprises the steps of:

connecting the components of the refrigeration circuit such that liquid refrigerant from the condenser circulates to the evaporator through an intermediate heat exchanger;

joining the components of the refrigeration circuit such that gaseous refrigerant from the evaporator circulates to the compressor;

diverting a portion of the refrigerant circulating from the condenser to the evaporator to the intermediate heat exchanger wherein the refrigerant is vaporized absorbing heat energy from the liquid refrigerant flowing to the evaporator;

routing the diverted portion of the refrigerant from the intermediate heat exchanger to the step of joining such that the diverted portion of the refrigerant from the intermediate heat exchanger flows to the compressor with the gaseous refrigerant from the evaporator at the same suction pressure.

2. The method as set forth in claim 1 and further including the step of expanding the liquid refrigerant from the step of diverting such that said refrigerant may vaporize in the intermediate heat exchanger absorbing heat energy from the refrigerant circulating from the condenser to the evaporator.

3. The method as set forth in claim 2 wherein the step of expanding includes regulating the refrigerant flow rate of the diverted portion of the refrigeration flow as a function of the temperature of the refrigerant circulating from the evaporator to the compressor.

4. A method of integrating a replacement component for a portion of an air conditioning system the air conditioning system including a refrigeration circuit having a compressor, condenser and evaporator wherein the component being replaced is designed to have a first refrigerant flow rate and the replacement component has a second higher refrigerant flow rate which comprises the steps of:

routing refrigerant from the condenser to the evaporator through a first flow path of an intermediate heat exchanger;

diverting a portion of the refrigerant from the step of routing to a second flow path of the intermediate heat exchanger; and conducting the diverted portion of refrigerant from the second flow path of the intermediate heat exchanger to the compressor such that the diverted portion of refrigerant bypasses the evaporator.

5. The method as set forth in claim 4 wherein the step of diverting includes expanding the diverted portion of refrigerant such that the diverted refrigerant may vaporize in the intermediate heat exchanger absorbing heat energy from the refrigerant flowing through the first flow path of the intermediate heat exchanger.

6. The method as set forth in claim 5 wherein the step of expanding includes regulating the flow rate of refrigerant diverted from flowing to the evaporator as a function of the temperature of refrigerant flowing from the evaporator to the compressor.

7. A method of connecting an evaporator designed to be utilized with a refrigeration circuit having a first design head pressure with a condenser and compressor of a refrigeration circuit having a second design head pressure for refrigerant flowing therethrough which comprises the steps of:

joining the condenser and the evaporator to an intermediate heat exchanger such that refrigerant circulates through the intermediate heat exchanger as refrigerant flows from the condenser to the evaporator;

connecting the evaporator to the compressor such that gaseous refrigerant circulates from the evaporator to the compressor; and diverting a portion of the refrigerant flowing from the condenser to the evaporator through the intermediate heat exchanger to the flow of refrigerant flowing from the evaporator to the condenser.

8. The method as set forth in claim 7 and further including the step of expanding the refrigerant from the step of diverting such that said refrigerant may vaporize in the intermediate heat exchanger absorbing heat energy from the refrigerant flowing from the condenser to the evaporator.

9. The method as set forth in claim 8 wherein the step of expanding includes regulating the flow rate of refrigerant diverted as a function of the temperature of refrigerant circulated from the evaporator to the compressor.

* * * * *